US005564124A

United States Patent [19]

Elsherif et al.

[11] Patent Number: 5,564,124

[45] Date of Patent: Oct. 15, 1996

[54] PERSONAL BODY VENTILATION SYSTEM

[75] Inventors: Dina Elsherif, Redondo Beach; Lawrence Green, Huntington Beach, both of Calif.

[73] Assignee: Bio-Medical Devices, Inc, Irvine, Calif.

[21] Appl. No.: 425,192

[22] Filed: Apr. 20, 1995

[51] Int. Cl.[6] ..... A41D 13/00

[52] U.S. Cl. ..... 2/69; 2/2; 2/DIG. 1; 62/259.3

[58] Field of Search ..... 2/7, DIG. 1, 81, 2/79, 102, 69, DIG. 1, 2, 94, 905, 171.3, 272, 243.1; 607/108, 112, 114; 62/259.3, 259.4, 259.1

[56] References Cited

U.S. PATENT DOCUMENTS

| | | | |
|---|---|---|---|
| 2,791,168 | 5/1957 | Mauch | 2/69 |
| 2,826,758 | 3/1958 | Kahn | 2/DIG. 1 |
| 2,994,089 | 8/1961 | Ferguson, Jr. et al. | 2/81 |
| 3,292,179 | 12/1966 | Iacono, Jr. et al. | 2/81 |
| 3,468,299 | 9/1969 | D'Amato | 2/81 |
| 3,710,395 | 1/1973 | Spano et al. | 2/81 |
| 4,744,106 | 5/1988 | Wang | 2/7 |
| 5,005,216 | 4/1991 | Blackburn et al. | 2/DIG. 1 |
| 5,014,355 | 5/1991 | Vollenweider, II | 2/DIG. 1 |
| 5,088,115 | 2/1992 | Napolitano | 2/81 |
| 5,243,706 | 9/1993 | Frim et al. | 2/DIG. 1 |

*Primary Examiner*—Amy B. Vanatta
*Attorney, Agent, or Firm*—G. Donald Weber, Jr.

[57] ABSTRACT

A personal body ventilation system includes a battery powered blower for providing air under pressure to the interior of a disposable garment formed by an inner air impervious layer and an outer air impervious layer. Porous-to-air open celled foam is incorporated into the garment at areas where cooling is desired and provides porous surfaces adjacent the body of the wearer from which the air under pressure in the interior of the garment may be directed against the body of the wearer. The system includes a filter arrangement in which a filter incorporated in the garment filters the ambient air prior to being drawn into the blower. The blower, the ouput of which is coupled to the garment in the rear by an elliptical connection, includes miniature radial turbine fans operating under a variable speed control. The circulated air may be heated or cooled or treated in various manners such as filtering or humidifying/dehumidifying to meet the requirements of the specific user environment.

25 Claims, 4 Drawing Sheets

PERSONAL BODY VENTILATION SYSTEM

BACKGROUND

1. Field of the Invention

The present invention relates, in general, to a personal ventilation apparatus and, in particular, to a personal ventilation system including a ventilation garment and air circulation apparatus for circulating air to parts of the body where ventilation is most needed. The invention relates especially to a personal ventilation system that may, in addition to circulating ambient air to selected parts of the body for evaporative cooling, be adapted to modify the ambient air for a specific operating environment to provide, for example, cooled, heated and/or filtered air to selected parts of the body.

2.Prior Art

A person working in a warm environment or performing tasks for which protective clothing is required may find the working conditions uncomfortable and may even experience a deterioration in performance or increased fatigue due to the build-up of body heat. Surgeons or staff working in operating rooms, for example, typically wear protective clothing which limits air circulation next to the body and inhibits evaporative cooling. Likewise, technicians working in clean room environments or with toxic waste cleanup crews or the like wear such protective gear. This may result in elevated body temperatures and increased stress.

One technique for keeping the body cool in such situations has been to employ a coolant-chilled garment. A coolant liquid such as chilled water is pumped through tubes which are attached to the garment to chill the garment. Such systems are typically closed systems in which the coolant is circulated through a cooling unit to maintain the garment and coolant at a chilled temperature. Although the entire system may be self contained, a person wearing the chilled garment must be tethered at all times to the cooling unit. The tether, of course, restricts the mobility of the wearer of the garment. Cooling by means of a liquid increases the weight the cooling garment and also the complexity and cost of the system. In addition, the cooling and tank units that are required for the liquid coolant may impede the movements of the wearer or others when the system is used in confined areas or when movement in the work area is necessary.

There have been systems employing air or refrigerated air for cooling individuals. However, these systems have been uncomfortable to wear, cumbersome to use, and frequently have the same disadvantages as the liquid cooling systems.

There is a need for a personal cooling system for use in garments required in environments such as operating rooms, clean rooms or similar environments that does not have the disadvantages of a liquid cooling system or the prior air cooling systems. In general, the personal body cooling system should be lightweight and comfortable so that additional stress is not placed on the wearer due to the cooling system itself. It is desirable that the personal cooling system be self-contained on the body of the wearer to allow the wearer to move freely without any tethers.

In order to interfere as little as possible with the normal activities of the wearer, the personal cooling system should not interfere with the mobility and manual dexterity of the wearer. The cooling system preferably should be reusable or, alternatively, inexpensive so that reuse is not necessary.

There is likewise a need for a personal system having the foregoing characteristics and advantages for use in other environments such as where heating, filtering or other modifications of an individual's environment are desired.

SUMMARY OF THE INSTANT INVENTION

It is, therefore, an object of the present invention to provide a personal body cooling system that does not impede the mobility or dexterity of the user.

Another object of the present invention is to provide such a system which cools the user by evaporative cooling.

A further object of the invention is to provide such a system wherein air is circulated to the areas of the body where heat may be expected to build up or where the removal of heat will most efficiently cool the body.

Another object of the present invention is to provide a cooling garment in which air is circulated to areas of the body at a controlled rate.

Yet another object of the present invention is to provide such a system that is self-contained on the body of the user and does not require the wearer to be tethered to external apparatus.

A further object of the present invention is to provide a personal body cooling system which is light weight and inexpesive.

Another object of the present invention is to provide a personal body cooling system that can be reusable in part and disposable in part.

Still another object of the present invention is to provide a personal body ventilation system having the foregoing features and advantages in which the circulated air may be heated, cooled or treated in various manners such as filtering or humidifying/dehumidifying to meet the requirements of the specific user environment.

Briefly, the personal body system of the present invention includes a ventilation garment and an air circulation unit for supplying air under pressure to the interior of the garment. The garment, which can be disposable, is formed by air-impervious inner and outer layers which are sealed together along the borders thereof to provide a garment having an interior space between the layers. Specific areas of the garment where cooling is needed or desired, such as under the arm openings, around the neck and head area, and at the front of the garment, are formed of a porous or other semi-porous material such as open-celled foam. This material is incorporated into the garment to provide porous surfaces adjacent the areas of the body to allow the outward flow of air from the interior of the garment for cooling the wearer. The air circulation unit is a lightweight unit employing a fan which causes air flow through the garment. Typically, the fan draws air into the garment through a filter, which may be either incorporated in or separate from the garment. The air, which can be treated, i.e., heated, cooled, filtered or the like, is forced out of the garment through the porous surfaces. Thermo-electric heating/cooling units may be incorporated into the air circulation unit to provide active heating or cooling.

DESCRIPTION OF A PREFERRED EMBODIMENT

Figure 1:
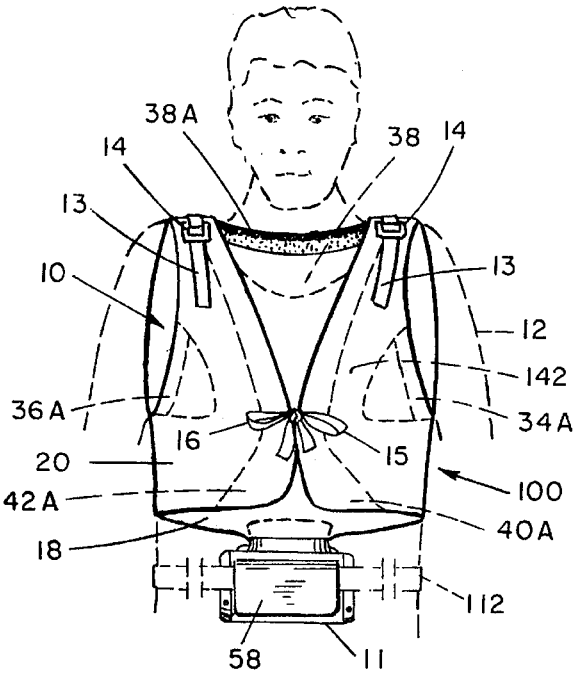
FIGS. 1, 2 and 3 are front, side and back views, respectively, of a personal body cooling system according to the present invention shown being worn by a user represented in phantom outline.
Figure 2:
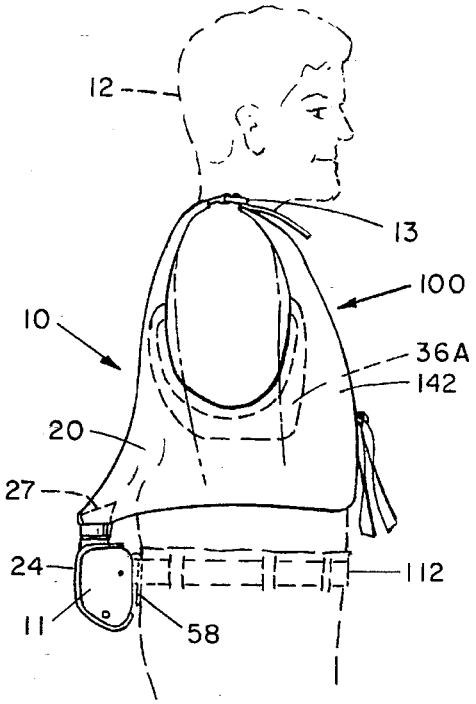
Figure 3:
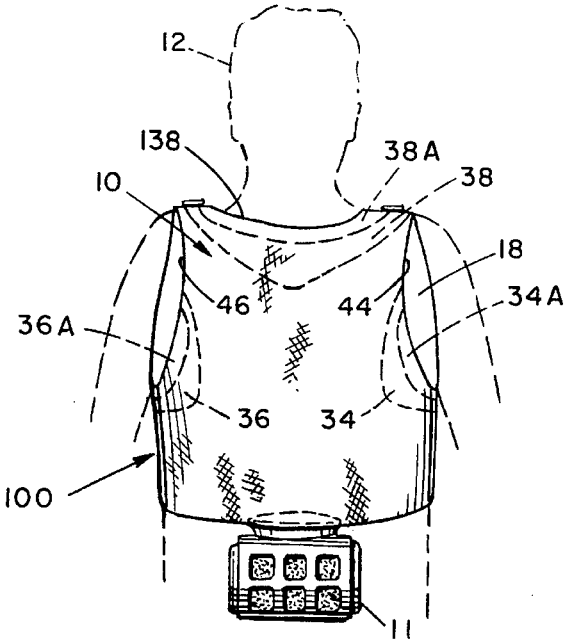

Referring concurrently to FIGS. 1–3, the preferred embodiment of the ventilation system 100 of the present invention includes a ventilation garment 10 and an air circulation or blower unit 11. The garment is a generally unitary garment formed of a fabric which is impervious to air. However, portions of the garment are formed of an air permeable material such as foam (rubber, plastic) or the like. For example, portions 34, 36, 38, 40 and 42 of the garment 10 permit air flow therethrough to provide cooling to the wearer.

The blower unit 11 is connected to the garment 10. As illustrated in FIGS. 1–3, the garment 10 is worn over the upper body or torso of the wearer 12 in the manner of a vest. Although the garment 10 is contemplated as being provided in a range of sizes in order to fit users of differing physical statures, the preferred embodiment is provided with shoulder adjustment straps 13 attached in the upper frontal area, (i.e., chest). In addition, corresponding buckles 14 or similar devices are attached at the top of the shoulders. Manipulation of the straps 13 and buckles 14 allows the garment to be further adjusted to fit the physique of the individual user 12.

The garment 10 is also provided with opposing straps 15 and 16 attached to the lower front portions of the garment 10. The straps 15 and 16 are arranged for tying the garment in the front to secure the garment in the proper position. Of course, it will be recognized that there are many other possible methods of adjusting the size of the garment 10 to allow a single size garment to be worn by individuals of various sizes. In addition, other fastening devices can be used for securing and maintaining the garment on the user. For example, hook and loop fasteners (sold under the trademark Velcro, for example) can be used instead of straps and buckles.

The garment 10 which, typically, extends from the shoulders to the waist of the user, has a downward extension 27 at the bottom center in the back. This extensions(or tail) of the garment is connected to receive air from the blower 11. The blower 11 is, preferably, battery powered and provides filtered ambient air to the interior of the garment 10 between the inner and outer layers 18 and 20 (as described infra). The blower 11 is adapted to be supported on the user's belt at the back of the user. Of course, a separate support belt may be utilized. Moreover, the blower may be tethered to a remote power source if self-contained battery power is not desired or required for the particular application.

Figure 4:
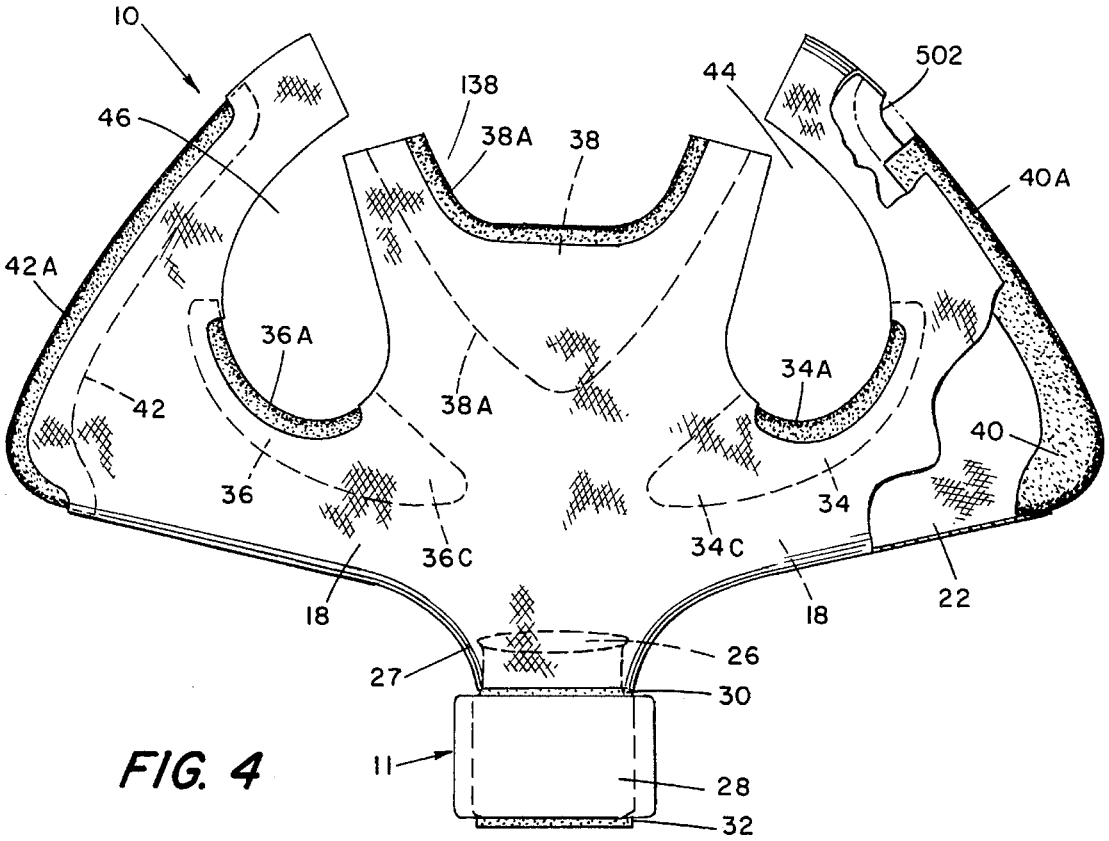
FIG. 4 is a partially cut away plan view of a personal cooling garment of the present invention with the garment separated at the shoulders and laid flat to more clearly show the features thereof.

FIG. 4 is a plan view of the garment 10 before it is joined together at the shoulders. As shown in FIG. 4, porous material pads 34, 36, 38, 40 and 42 (depicted partially in dashed outline) are incorporated in the garment 10 to provide porous surfaces facing the body of the wearer where cooling/ventilation is desired. Such areas are located under the left arm opening at 34A, under the right arm opening at 36A, around the neck area of the garment at 38A and along the left 40A and right 42A front edges, respectively, of the garment 10. The flat surfaces of the foam sheets 34, 36, 38, 40 and 42 are sealed to the inner surfaces of the inner layer 18 and the outer layer 20 by suitable adhesive. However, inner layer 18 is cut or configured to permit portions of the pads to be exposed.

The exposed surfaces 34A, 36A, 38A, 40A, and 42A each represent a portion of the surfaces of foam pads 34, 36, 38, 40, and 42, respectively. The exposed surfaces 34A–42A of the porous material are located so that the air supplied to the interior space 25 of the garment 10 by blower 11 is exhausted therethrough, onto against and/or over the body of the wearer 12.

Air supplied to the interior space 25 of the garment 10 through the air inlet 26 enters the foam sheets through the interior edges of the sheets. This air flow may be somewhat laminar because of the size and shape of the goods involved. The size and shape of each foam sheet 34–42 and the size and shape of each exposed porous surface 34A–42A is chosen to control the air flow through the exposed porous surfaces in order to produce a defined air flow in volume, velocity and direction at each exposed porous surface and thus provide the desired amount of cooling/ventilation at each exposed porous surface. The air reaching any particular part of an exposed porous surface 34A, 36A, 38A, 40A and 42A will have traveled a unique path from the blower 11 to that exposed surface. This unique path will determine the rate of flow through the exposed porous surface for any particular blower output setting.

The porosity of the foam is selected to allow air to flow out of the porous surfaces 34A, 36A, 38A, 40A and 42A at the desired rate (in both volume and velocity) under the air pressure from the blower 11. For example, the foam sheets should maintain a sufficient pressure in the interior of the garment to produce the desired flow rate but not so great as to produce excessive puffing of the garment 10 which may decrease the comfort of the garment. The initial air pressure and flow rate of air entering the air inlet 26, the distance the air travels while between the inner and outer layers 18 and 20 (i.e. the inner surfaces of these layers provide resistance to the air flow) until it reaches the foam sheets, the angle and pressure of the air entering the edges of the foam sheets, and the distance traveled within the foam sheets, all contribute to the final rate of air flow from the exposed porous surfaces 34A, 36A, 38A, 40A and 42A. These factors allow a garment to be designed to implement a flow pattern a having desired amount of air flow in specific cooling/ventilation areas. For example, it may be desirable to have approximately uniform air flow per unit area of exposed porous surface throughout the garment 10 or perhaps a greater or less air flow across a specific area of the wearer's body. Such designs may be accomplished by selecting the appropriate amounts of exposed foam surface 34A, 36A, 38A, 40A and 42A and appropriate size and shape of the foam sheets 34, 36, 38, 40, and 42.

In the preferred embodiment illustrated, it was desired to have approximately uniform air flow per square area of exposed porous surface 34A, 36A, 38A, 40A and 42Aa. An open celled polyurethane foam sheet of 1.2 pounds density and ⅝ inch in thickness is used. The porous sheets 34, 36, 38, 40 and 42 and 0 the exposed surfaces 34A, 36A, 38A, 40A and 42A of the porous sheets were empirically designed to provide the desired air flow in the various areas. As shown in FIG. 4, the foam sheets 34 and 36 located under the arm openings 44 and 46 have a greater dimension in the regions 34C and 36C, respectively, which receive air in a more direct path from the blower 11 and taper off in areas where the air impact is not as direct. The size of exposed surfaces 34A and 36A is tailored to provide a substantially uniform flow across the under arm areas. In a similar manner, the foam sheet 38 in the neck region has a greater dimension in the area where air is received in a more direct path from the blower. The various dimensions of the chest sheets 40, 40A and 42, 42A can be seen to follow these same general considerations.

The foam sheets also maintain the shape of the garment 10. The use of porous foam having a substantial thickness for the sheets 34–42 provides an important structural foundation for the garment 10. The foam sheets prevent the garment from squeezing in on the wearer 12 when the blower 11 is in operation and also serve to maintain the shape of the garment to maintain the desired orientation and location of the exposed porous surfaces 34A, 36A, 38A, 40A and 42A relative to the body of the wearer.

Figure 5:
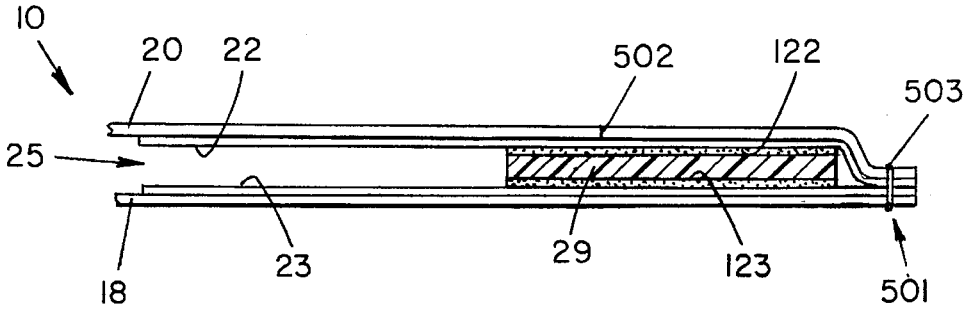
FIG. 5 is a schematic representation of a cross-section of the garment of the instant invention.

Referring now to FIG. 5, there is shown an enlarged cross-sectional view of the construction of a potion of garment 10. Both the inner layer 18 and the outer layer 20 are preferably formed from a strong, lightweight, synthetic material such as spun-bonded polyester, although it will be recognized that many materials and/or coatings are suitable for use as the air impervious layers. The layers 18 and 20 may be fabricated of any suitable material which is impervious to air. Alternatively, the layers may be coated, impregnated or otherwise treated on either side with a substance to render the material impervious to air.

In a preferred embodiment, the inward, opposing surfaces of the fabric layers 18 and 20 are coated with thin, lightweight, plastic coatings 22 and 23, respectively. Typically, the coatings 22 and 23 are polyethylene or the like. The coatings make the fabric layers sufficiently impervious to contain air under the pressure of the blower unit 11.

A sheet 29 of porous material, typically a foam material, is sealed to the plastic coating 22 and 23 by suitable adhesive layers 122 and 123. However, as shown, at least a portion of the sheet 29 is not sealed to and covered by the outer fabric layer 20.

The edges of the inner and outer fabric layers 18 and 20, the porous sheet 29 and any appropriate coatings and adhesives are joined together in a sealed edge 501. The edge may be formed by stitching, sonic welding, double-sided tape, crimping or any other method and means suitable to retain sufficient air pressure within the garment to establish air flow through the porous material which is not covered by a fabric layer. As shown in FIG. 4, the pads of porous material are disposed in specific areas of the garment, such as under the arm openings 136, around the neck opening 138, and at the front 142 of the garment 10. The porous material serves to direct and meter the outward flow of air to provide cooling/ventilation for the wearer. Thus, air forced into space 25 between the coated surfaces of the inner and outer fabric layers, is free to pass through porous sheet 29 at the exposed, unsealed surface area.

Figure 6:
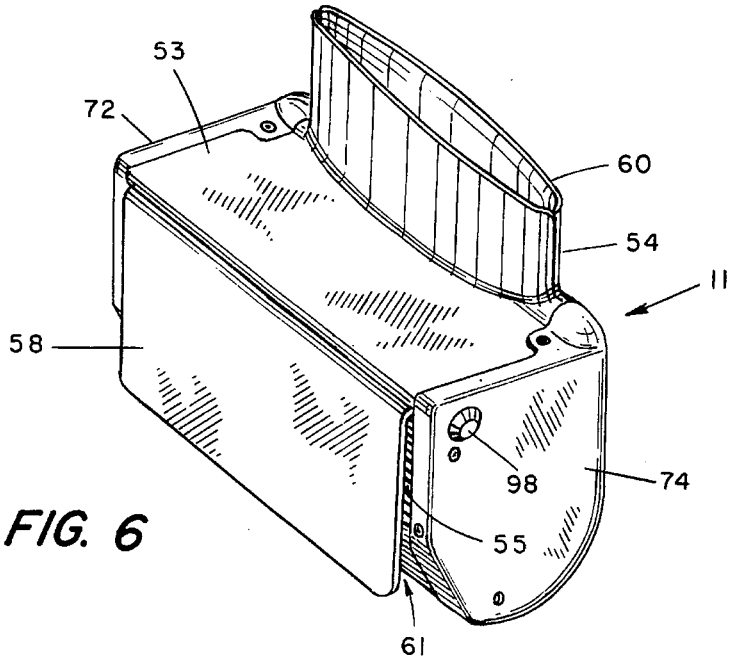
FIG. 6 is a perspective view of a belt mountable air circulation unit of the present invention.

Referring now to FIG. 6, there is shown a rear perspective view of a preferred embodiment of the air circulation unit 11. The circulation unit or blower 11 of the personal ventilation system comprises a housing which is, typically, formed of a lightweight plastic. The housing includes a generally rectilinear top and back surface with an arcuate front surface. As shown, the air outlet 54 extends from the top surface 53 of the blower 11. The end walls 72 and 74 provide end closures to the housing. The throat of the air outlet 54 is of substantially elliptical cross-section with the longer dimension being parallel to the front of the blower. The air outlet 54 terminates at a slanted end having a circumferential outward facing lip 60. The slanted, rimmed air outlet 54 is, thus, adapted to be securely held in the extension 27 of the garment 10 thereby to couple the blower output to the interior of the garment.

In this embodiment, the blower 11 includes a belt clip 58 which is attached at the rear of the housing. The belt clip 58 includes a narrow channel 61 for receiving a belt or the like for supporting the blower in an upright position. A control switch 98 can be provided for controlling the operation of the blower 11 as discussed hereinafter.

Figure 7:
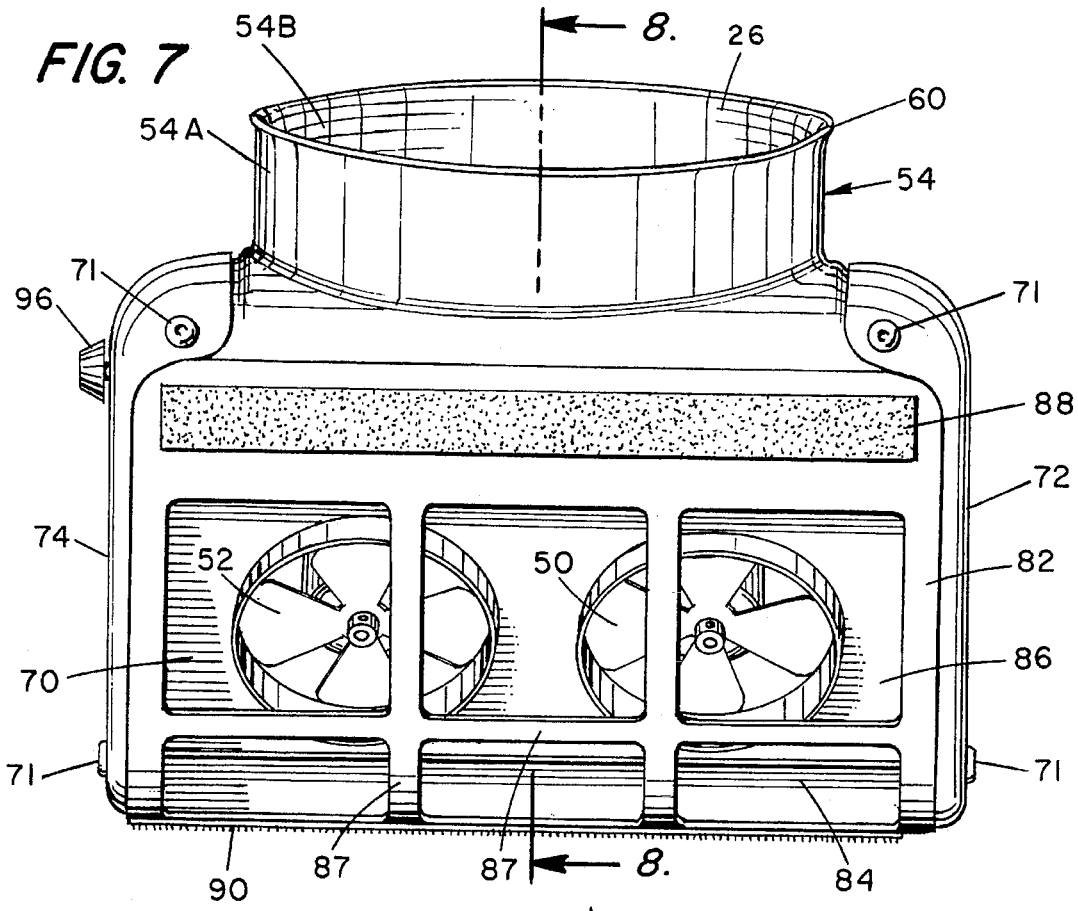
FIG. 7 is a front elevation view of the side of the air circulation unit of the instant invention.

Referring now to FIG. 7, there is shown a front elevation view of the blower 11 of the instant invention. The front section of outlet 54 is formed as a portion of lower wall 70. The rear section of the outlet 54 is formed as part of the top surface 53 as shown in FIG. 6. The upper end of front wall 82 which functions as a filter support is disposed in front of the upper portion of lower wall 70. The end walls 72 and 74 overlap and contain the walls 70 and 82. The several walls are fastened together by suitable fasteners such as rivets 71 or the like.

The front wall includes one or more openings 86 defined by the horizontal and vertical strips 87. The opening communicates with the chamber or plenum 84.

The fans 50 and 52 are mounted on the lower portion of wall 70 and extend into (and communicate with) the plenum 84.

The fasteners 88 and 90 are provided at the top and bottom areas of the front wall 82. These fasteners take the form of Velcro (or similar hook and loop) strips which engage counterpart strips on the filter 24 described infra.

The knob 98 represents a control mechanism for controlling the operation of the fans 50 and 52.

Figure 8:
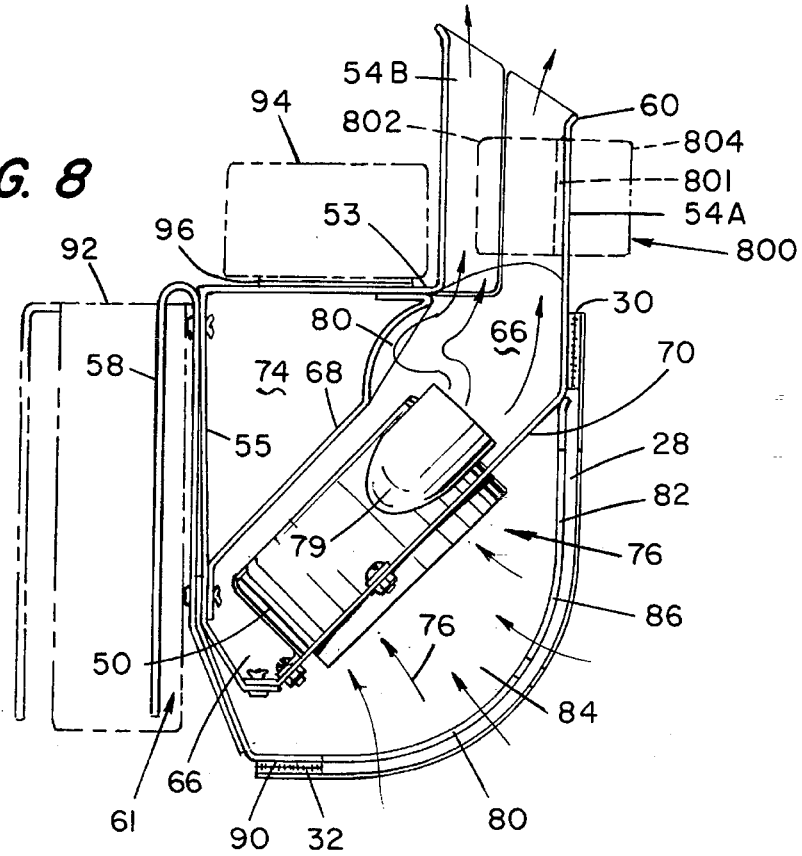
FIG. 8 is a cross-sectional view of the air circulation unit taken along line 8—8 in FIG. 7.

Referring now to FIG. 8, there is shown a cross-sectional view of the blower 11 taken along the lines 8—8 in FIG. 7. The blower 11 includes a central chamber 66 extending virtually the entire width of the blower (see FIG. 7). The chamber 66 includes upper wall 68 and lower wall 70. The lower ends of the upper and lower walls of chamber 66 are joined to the rear wall 55 of the housing of blower 11 which, in this embodiment, is an integral part of top surface 53. The upper end of lower wall 70 is connected to one sidewall of the outlet 54. The upper wall 68 is joined to the upper surface 53. The upper wall 68 can be formed to include a pair of channels 80 which, effectively, enlarge the chamber 66 in the region of the fan outputs to provide an unimpeded path from the fans to the outlet 54.

The chamber 66 extends upwardly toward the top of the blower and communicates with the air outlet 54. As is clear in Figure 8, the air outlet has front and rear sections 54A and 54B, respectively, formed as parts of front wall 82 and top surface 53, respectively. A miniature radial turbine fan 50 is mounted on the lower wall 70 within chamber 66. (A similar fan 52 can be mounted next to fan 50 as shown in FIG. 7.) The fan draws air in axially, as suggested by arrows 76, and expels air tangentiallly through ports 79 to the outlet 54, as suggested by arrows 78.

The blower 11 includes a front wall 82 which functions as a filter support. The front wall extends in a curved plane from the rear of the blower 11 around the fan chamber 66. The lower end of wall 82 is attached to the rear wall 55 at or adjacent to the mounting of the upper wall 68 of fan chamber 66. The upper end of wall 82 fits against lower wall 70 of fan chamber 66. The curved support wall 82 defines an ambient air intake area 84 adjacent to chamber wall 70. The air intake impeller of the turbine fan 50 (as well as fan 52) is mounted in openings in wall 70 and extends into the air intake area 84. The filter support 82 includes one or more large openings 86 by which the air intake area 84 communicates with the external ambient environment to the rear of the blower.

The belt support 58 is attached to the housing, in particular to the rear wall 55 and/or the front wall 82. A suitable juncture is formed where upper wall 68 of fan chamber 66 is attached to the rear wall 55 and the front wall 82.

The connector strips 88 and 90 at the top and bottom of the blower on front wall 82 are positioned to mate with corresponding Velcro strips 30 and 32 of a filter 28. The filter 28 can be mounted in the cooling/ventilation garment 10. When the air outlet 54 of blower 11 is positioned in the air inlet at the extension 27 of the garment 10, the filter 28 may be disposed over the filter support member 82 and secured in place with the connector strips.

The radial turbine fan 50 is adapted to be powered by a battery pack such as a belt-mounted battery pack 92 (shown in phantom outline) or by a battery pack 94 (shown in phantom outline) that may be mounted on the top surface 53 of the housing in front of the air outlet 54 by suitable means such as a Velcro strip 96. The battery pack 92 or 94 is coupled to drive the turbine fans through a speed control 98 (see FIG. 6) such as a conventional rheostat or a multiple speed control to adjust the output of the fans to control the air flow through the garment 10.

It is contemplated that the air output from the blower may be heated, cooled or treated in numerous ways. Thus, an optional thermo-electic heating/cooling unit 800 may be incorporated into the blower 11 to provide active heating or cooling of the circulated air. As shown in phantom, the thermo-electric heating/cooling unit 800 may conveniently be disposed in air outlet 54 of the blower.

Figure 9:
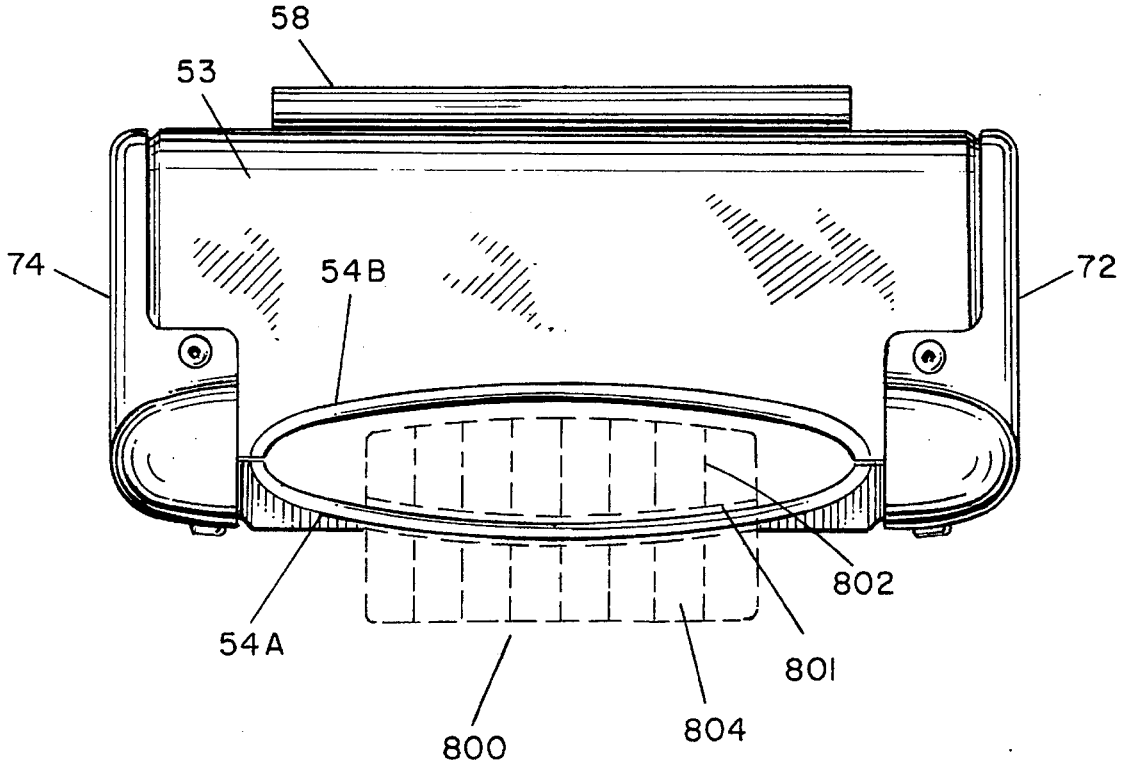
FIG. 9 is a top plan view of the air circulation unit.

Referring now to FIG. 9, there is shown a top view of the unit 11 which includes a heating/cooling wafer 801 thermally coupled to fins 802 which extend into blower outlet 54 and to fins 804 which extend into the ambient environment. As is customary in the operation of such thermo-electric units, temperature reduction in the circulated air is obtained when the fins 802 in the air outlet are cooled by the operation of the heating/cooling wafer 801 and the removed heat is dissipated through the external fins 804. Conversely, a temperature increase is obtained when the internal fins 802 are heated by the wafer 801 in a conventional manner.

It will be recognized that the blower 11 may also incorporate additional means for treating the circulated air such as modifying the humidity of the circulated air or filtering or adding treatments to the circulated air.

Figure 10:
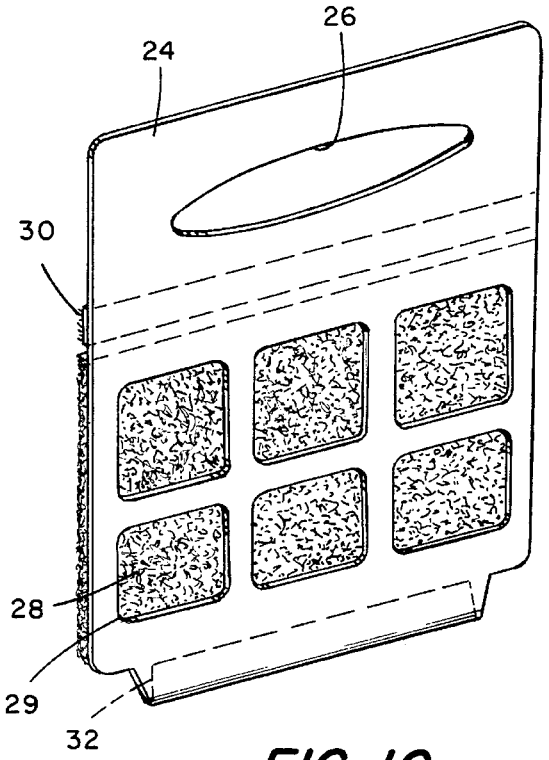
FIG. 10 is an enlarged view of the air circulation filter shown in FIGS. 3 and 9.

Referring now to FIG. 10, there is shown an enlarged view of the filter portion of the blower 11. In this embodiment, the filter comprises a rectilinear support sheet 24 having an elliptical opening 26 and one of more filter openings 29 therein. The elliptical opening 26 is adapted to interact with a corresponding opening in the inner layer 18 of garment 10. In one embodiment, inner layer 18 is sealed to the sheet 24 around the opening so that the elliptical opening provides an air inlet directly into the interior of the garment 10. The sheet 24 supports a filter layer 28 which is disposed below the elliptical opening 26 and adjacent the filter opening 29. Two horizontal hook and loop (i.e. Velcro) strips 30 and 32 are disposed on the sheet 24 above and below the filter 28, respectively. As discussed supra, opening 26 is adapted to receive the air outlet 54 of the blower 11. The Velcro strips 30 and 32 are adapted to mate with corresponding Velcro strips on the blower 11 to position the filter 28 in the path of the ambient air drawn into the plenum 84 in blower 11.

In utilization, the cooling/ventilation garment 10 can be worn next to the skin of the wearer, worn over a thin undergarment as a second layer, and/or worn underneath an outer protective garment such as a surgical smock. The garment 10 may be incorporated as a removable or non-removable lining in an outer garment by conventional techniques.

The blower 11 is, typically, mounted at the belt level of the wearer with the slanted end of the outlet 54 of the blower 11 securely disposed in the extension 27 of the garment 10. In addition, the corresponding opening 26 of filter 28 is juxtaposed to a corresponding opening in extension 27. The filter 28 is then wrapped downward over the filter support member 82 of the blower 11 and secured by the corresponding Velcro strips on the filter 28 and the blower 11.

Upon the application of battery power to the radial turbine fans 50 and 52 via the speed control 98, the turbine fans draw ambient air through the filter 28 into the air intake area 84. The filter 28 may be adapted to remove various contaminants and unwanted matter depending on the environment where the suit is being used. Typically, the filter 28 will remove, at least in the ambient, expected contaminants such as particles that may deleteriously affect the performance of the foam sheets. The drawn-in air is then expelled under pressure from the tangential outputs of the turbine fans 50 and 52 into the chamber 66 and directed upward through chamber 66, channels 78 and the outlet 54 through the air inlet 26 of the garment 10.

The pressurized air is circulated within the garment 10 between the air impervious surfaces of the inner and outer fabric layers 18 and 20. The air then diffuses through the foam sheets 34, 36, 38, 40 and 42 and is expelled through the exposed porous surfaces 34A, 36A, 38A, 40A and 42A in a controlled flow of air across or against the body of the wearer to promote heat removal or evaporation in those areas. The areas of the body which usually have the most heat buildup and, therefore, need the most cooling/ventilation, are provided the greatest air flow through the metering provided by the design of the foam sheets including the size and orientation of the exposed porous surfaces.

It is noted that porous materials other than the porous foam of the preferred embodiment may be employed in place of the foam sheets within the purview of the invention. For example; melt-blown polypropylene, as well as various woven or non-woven fabrics (felt fabric, for example) may be constructed to provide a suitable porous material which will direct and meter the flow of air under pressure through the exposed porous surfaces within the concept of the invention. The porous material may also function as a filter material to remove or absorb unwanted contaminants from the air passing through the garment.

In order to allow for differences in the external environment in which the cooling/ventilation system is being used and for individual differences in amount of the cooling/ventilation desired for the comfort of the individual wearer, the variable speed control allows the adjustment of the pressurized flow of air into the garment 10 to accommodate an individual's preference.

The cooling/ventilation system of the present invention is partially reusable and partially disposable. The blower 11 is intended to be reused indefinitely whereas the garment 10 is intended to be disposable. The garment 10 may be reused until it becomes soiled, but is then to be discarded.

It is to be understood that garments other than the vest-like garment 10 of the preferred embodiment such as larger or longer cooling/ventilation garments or garments intended to cool other parts of the body are within the teachings of the invention. For example, a belt-like, hood-like, or trouser-like garment having such inwardly facing porous surfaces as in the disclosed preferred embodiment is considered within the teachings of the present invention.

Although the present invention has been described as a cooling/ventilation system including a cooling/ventilation garment, it will be recognized that the present invention can be used with a source or means for heating air in order to direct heated air through the porous surfaces to provide a personal warming system. For example, the blower 11 or garment 10 may contain a heating element(s) to heat the air prior to its being exhausted through the porous surfaces of the garment. Similarly, the air may be chilled prior to introduction into the garment, to provide additional cooling/ventilation capability.

Thus, there is shown and described a unique design and concept of a cooling/ventilation system. The particular configuration shown and described herein relates to a cooling/ventilation garment. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limited by the claims appended hereto.

We claim:

1. A garment for selectively supplying air under pressure to an area of the body of a wearer comprising:

an inner layer adapted to be disposed closer to the body of the wearer;

said inner layer formed of material impervious to air;

said inner layer including an opening therethrough;

an outer layer disposed on top of said inner layer;

said outer layer formed of material impervious to air;

porous means joined to at least one of said inner layer and said outer layer and positioned adjacent said opening in said inner layer to provide a porous surface adjacent the area of the body to which air is intended to be supplied; and an air inlet for receiving air under pressure;

said inner layer, said outer layer and said porous means being sealed at the peripheral edges thereof such that said garment is impervious to air except for said porous surface whereby air is expelled from the garment under pressure through said porous surface.

2. The garment recited in claim 1 wherein, said porous means provides a structural foundation for said garment to thereby maintain said porous surface adjacent to said area of the body.

3. The garment recited in claim 1 wherein, said porous means provides a plurality of porous external surfaces and is adapted to produce a defined air flow through said plurality of porous external surfaces.

4. The garment recited in claim 1 wherein, said porous means is selected from the group consisting of a foam material, a woven material, a non-woven material, a fabric material, and a filter material.

5. The garment recited in claim 1 including, blower means for providing air under pressure to the air inlet of said garment.

6. The garment recited in claim 5 including, filter means for filtering the air provided under pressure by said blower means.

7. The garment recited in claim 6 wherein, said filter means is part of said garment.

8. The garment recited in claim 7 wherein, said blower means is adapted to be mounted on the body of a wearer and to receive said filter means attached to said garment.

9. The garment recited in claim 6 wherein, said blower means takes in ambient air and said filter is disposed in the path of said ambient air taken in by said blower.

10. The garment recited in claim 1 wherein, said porous means comprises at least one foam sheet having a portion of its surfaces sealed between said inner layer and said outer layer and having a portion of at least one surface not so sealed, said portion of at least one surface not so sealed being disposed adjacent said area of the body when said garment is worn.

11. The garment recited in claim 10 wherein, said porous means is adapted to produce a defined air flow through said portion of at least one surface not so sealed.

12. The garment recited in claim 10 wherein, said porous means provides a structural foundation for said garment to maintain said portion of at least one surface not so sealed adjacent said area of the body.

13. The garment recited in claim 10 wherein, said porous means is sealed to said inner and outer layers by an adhesive material.

14. The garment recited in claim 1 wherein, at least one of said inner and outer layers is fabricated of a strong, lightweight synthetic material.

15. The garment recited in claim 1 wherein, each of said inner and outer layers is fabricated of a thin, lightweight fabric which is coated with a thin, lightweight, impervious coating.

16. The garment recited in claim 1 wherein, said inner layer, said outer layer and said porous means are sealed at the peripheral edges by a method selected from the group of methods consisting of stitching, sonic welding, taping and crimping.

17. The garment recited in claim 1 including, a blower for mounting on the body of a wearer, said blower having a front to be disposed adjacent the body of the wearer and a rear to be disposed away from the body of the wearer, said blower including, a housing;

fan means mounted in said housing for drawing ambient air into said fan means through the rear of said housing and expelling said air under pressure from said fan means; and outlet means for coupling air under pressure to said inlet means of said garment.

18. The garment recited in claim 17 including, means for treating said air being expelled from said blower.

19. The garment recited in claim 18 including, filter means disposed at the rear of said housing to filter the air drawn into said fan means.

20. The garment recited in claim 17 including, attachment means disposed at the front of said housing for attaching said housing to a support device.

21. The garment recited in claim 17 wherein, said housing forms a plenum in which said fan means is mounted.

22. The garment recited in claim 17 wherein, said fan means comprises at least one radial turbine fan.

23. The garment recited in claim 17 including, power source means mounted on said housing to provide power to said fan means.

24. The garment recited in claim 18 wherein, said means for treating said air includes a temperature control apparatus.

25. The garment recited in claim 23 including, speed control means connected to said power source and to said fan means to control the operating speed of said fan means.

* * * * *